US008708249B2

(12) United States Patent
Lecluse et al.

(10) Patent No.: US 8,708,249 B2
(45) Date of Patent: Apr. 29, 2014

(54) FUEL INJECTOR WITH AN IMPROVED VALVE CONTROL ARRANGEMENT

(75) Inventors: Eric Lecluse, Pezou (FR); Richard Denis Jacques Alain Enters, Vineuil (FR); Eric Charleux, Vineuil (FR)

(73) Assignee: Delphi International Operations Luxembourg S.A.R.L., Luxembourg (LU)

( * ) Notice: Subject to any disclaimer, the term of this patent is extended or adjusted under 35 U.S.C. 154(b) by 649 days.

(21) Appl. No.: 12/918,135

(22) PCT Filed: Feb. 23, 2009

(86) PCT No.: PCT/EP2009/052132

§ 371 (c)(1), (2), (4) Date: Sep. 30, 2010

(87) PCT Pub. No.: WO2009/103819

PCT Pub. Date: Aug. 27, 2009

(65) Prior Publication Data

US 2011/0017844 A1 Jan. 27, 2011

(30) Foreign Application Priority Data

Feb. 21, 2008 (EP) ..... 08101850

(51) Int. Cl.
*F02M 45/10* (2006.01)

(52) U.S. Cl.
USPC ..... 239/96; 239/88; 239/124; 239/127; 239/533.9; 239/585.1

(58) Field of Classification Search
USPC ..... 239/88, 96, 124, 127, 533.2, 533.8, 239/533.9, 585.1
See application file for complete search history.

(56) References Cited

U.S. PATENT DOCUMENTS 6,655,602 B2 * 12/2003 Shafer et al. ..... 239/88
6,880,766 B2 * 4/2005 Lewis et al. ..... 239/88

(Continued)

FOREIGN PATENT DOCUMENTS

DE 10 2006 000023 7/2006
DE 10 2006 000461 3/2007

(Continued)

OTHER PUBLICATIONS

International Search Report dated May 26, 2009.

(Continued)

*Primary Examiner* — Steven J Ganey
(74) *Attorney, Agent, or Firm* — Mark H. Svoboda

(57) ABSTRACT

A fuel injector for a compression ignition internal combustion engine which comprises a fuel injection valve having an injection valve member which is moveable in use, under the influence of fuel pressure within an injection valve member control chamber acting upon it, between a closed position and an open position. The fuel injector further comprises a high pressure fuel supply passage to the injection valve member control chamber, and an actuator operable to open and close a discharge valve connected between the injection valve member control chamber and a fuel outlet passage to a low pressure reservoir or drain. A shut-off valve is provided in the high pressure fuel supply passage and the shut-off valve has a shut-off valve member which is moveable in use, under the influence of fuel pressure within a shut-off valve member control chamber acting upon it, between a closed position and an open position. The shut-off valve member control chamber is connectable to the low pressure reservoir or drain via the discharge valve, and a fuel transfer passage is provided between the injection valve member control chamber and the low pressure reservoir or drain.

9 Claims, 6 Drawing Sheets

(56) References Cited

U.S. PATENT DOCUMENTS

| | | | | |
|---|---|---|---|---|
| 7,334,741 | B2 * | 2/2008 | Benson et al. | 239/96 |
| 2004/0000600 | A1 | 1/2004 | Peters et al. | |
| 2006/0162695 | A1 | 7/2006 | Shibata | |
| 2007/0215714 | A1 | 9/2007 | Horiuchi et al. | |

FOREIGN PATENT DOCUMENTS

| | | |
|---|---|---|
| DE | 10 2007 000150 | 9/2007 |
| EP | 1 163 440 | 10/2005 |
| FR | 2 756 595 | 6/1998 |
| JP | 2005-83237 | 3/2005 |
| JP | 2005-207323 | 8/2005 |
| JP | 2008-8163 | 1/2008 |

OTHER PUBLICATIONS

European Search Report dated Aug. 11, 2008.
Agent Letter Regarding China Office Action (includes English translation).
China Office Action dated Aug. 3, 2012.
Japan Office Action dated Jul. 2, 2012.

* cited by examiner

FUEL INJECTOR WITH AN IMPROVED VALVE CONTROL ARRANGEMENT

TECHNICAL FIELD

The present invention relates to a fuel injector with an improved valve control arrangement for positioning a valve needle of a fuel injector in a position whereby injection of fuel occurs, and in a position whereby injection of fuel is prevented. In particular, the present invention relates to a valve control arrangement which utilises a shut-off valve to control the flow of high pressure fuel between a high pressure fuel supply and an injection valve needle control chamber in order to eliminate static leakage from the injector, reduce dynamic leakage and improve injector performance, particularly the robustness of the injector and the opening and closing speed of the valve needle.

SUMMARY OF THE INVENTION

It is known to control the movement of a valve needle within a fuel injector, to commence and cease fuel injection, by utilising a discharge valve operated by an actuator to control the pressure of fuel within a valve needle control chamber. A valve control arrangement of this type is described in EP 1 163 440. In the described arrangement a thrust surface provided at the end of the valve needle that is distal from the valve seat can be subjected to a force resulting from pressurised fuel within the needle control chamber acting against it and a medial thrust surface provided between the distal and proximal ends of the valve needle can be subjected to a force resulting from pressurised fuel within an associated annular chamber in the nozzle body.

Fuel from a high pressure fuel supply source can flow into the valve needle control chamber through an inlet orifice (INO) in the inlet passage. Fuel can flow out from the valve needle control chamber to a low pressure reservoir or drain through a spill orifice (SPO), when the discharge valve is opened by a solenoid actuator. Fuel flows into the annular chamber within the nozzle body from the high pressure fuel supply source and flows out from the chamber through injection orifices which are opened and closed as the valve needle is raised or lowered respectively.

In operation, to raise the valve needle and hence open the injection orifices the discharge valve is opened, under the direct control of the solenoid actuator. The fuel within the valve needle control chamber is then able to flow out to the low pressure drain via the SPO. Because the INO is present in the high pressure fuel supply line to the valve needle control chamber the pressure of the fuel within the valve needle control chamber is reduced and thus the downwards force applied to the valve needle, as a result of the fuel acting upon the distal thrust surface, is reduced. High pressure fuel is still acting on the medial thrust surface of the valve needle and the resulting upwards force applied to the valve needle thrust surface is greater than the downwards force applied to the valve needle and thus the valve needle starts to move upwards. When the injection orifices open the fuel within the chamber in the nozzle body flows out to an engine cylinder, which is at a relatively low pressure, and thus the fuel pressure within the annular chamber in the nozzle body reduces. As the pressure of the fuel within the annular chamber in the nozzle body reduces the upwards force acting on the valve needle reduces. However, at this point the upwards force acting on the thrust surface is still greater than the downwards force applied to the valve needle and thus the valve needle remains in a raised position and fuel injection through the injection orifices continues.

In order to lower the valve needle, close the injection orifices and thus cease the injection of fuel, the discharge valve is moved to a closed position. This is achieved by stopping the supply of electrical current to the solenoid and under the direct action of a helical compression spring acting on the discharge valve member. This closes the outlet from the valve needle control chamber to the low pressure drain and thus, since high pressure fuel is still being supplied to the needle control chamber, via the INO, the pressure of fuel within the needle control chamber is raised. The downwards force applied to the valve becomes greater than the upwards force and thus the valve needle moves downwards.

This prior art valve control arrangement utilises a hydraulically balanced discharge valve. It is necessary to use a hydraulically balanced discharge valve because a small solenoid actuator is used to control movement of the discharge valve and such an actuator is not able to generate sufficient force to close an unbalanced valve against the high pressure of the fuel within the valve needle control chamber acting against it. It is desired to use a small solenoid actuator as this enables the actuator to be placed within the body of the injector. Furthermore, there is a cost reduction associated with the use of a small actuator.

A disadvantage of hydraulically balanced valves is that they suffer from static leak. This is leak across the discharge valve from the high pressure side, i.e. the valve needle control chamber, to the low pressure drain and is exacerbated by the high pressures and temperatures of the fuel to which the discharge valve is subjected. This static leak requires a higher pump capacity and results in wasted energy as pressurised fuel escapes to the low pressure drain.

As mentioned above, it is not possible to use an unbalanced valve as the force required to drive it could only be supplied by a larger solenoid actuator, which would not fit within the injector body, or by a different type of actuator, such as a piezo-electric actuator, which would be prohibitively expensive.

Also, the prior art control arrangement suffers from dynamic fuel leakage when the valve needle is raised. The dynamic leakage occurs between the high pressure fuel inlet and the low pressure reservoir or drain, via the piston control chamber when the discharge valve is open. The dynamic leakage is disadvantageous for the same reasons set forth above in respect to static leakage.

The inlet orifice and the spill orifice are present in the valve control arrangement of the prior art to enable the greatest closing speed of the valve needle, i.e. the shortest delay between the discharge valve being closed and the pressure of fuel within the valve needle control chamber reaching a level at which the downwards force applied to the valve needle is greater than the force applied upwards, and to enable the greatest opening speed of the valve needle, i.e. the shortest delay between the discharge valve being opened and the pressure of fuel within the valve needle control chamber reducing to a level whereby the upwards force applied to the valve needle is greater than the downwards force applied to the needle.

In order to have the greatest closing speed for the valve needle it is necessary to fill the valve needle control chamber as quickly as possible. The ideal situation would be to have an unrestricted fuel inlet, i.e. no inlet orifice and a heavily restricted fuel outlet, i.e. a small spill orifice. However, it is also desirable to have a high opening speed for the valve needle and this requires that the valve needle control chamber is emptied as quickly as possible through the outlet passage. In this case it is desirable to have an unrestricted fuel outlet, i.e. no spill orifice and a heavily restricted fuel inlet, i.e. a small inlet orifice.

There is hence a conflict between the requirements for fast opening and fast closing of the valve needle. A compromise is sought and the inlet orifice and outlet orifice are matched to give the best attainable operating characteristics.

Thus the prior art control arrangement is limited by suffering from undesirable levels of static and dynamic leakage and from having a relatively long delay time between actuation of the discharge valve and movement of the valve needle.

There is hence a requirement for a valve control arrangement which provides a reduction in valve needle movement time and is also able to utilise a small, low cost actuator which does not suffer from static leak problems.

Accordingly, the present invention provides a fuel injector for a compression ignition internal combustion engine comprising a fuel injection valve having an injection valve member moveable, in use, under the influence of fuel pressure within an injection valve member control chamber acting upon it, between a closed position and an open position, a high pressure fuel supply passage to the injection valve member control chamber, and an actuator operable to open and close a discharge valve connected between the injection valve member control chamber and a fuel outlet passage to a low pressure reservoir or drain, characterised in that a shut-off valve is provided in the high pressure fuel supply passage, the shut-off valve having a shut-off valve member moveable, in use, under the influence of fuel pressure within a shut-off valve member control chamber acting upon it, between a closed position and an open position, wherein the shut-off valve member control chamber is connectable to the low pressure reservoir or drain via the discharge valve, and wherein a fuel transfer passage is provided between the injection valve member control chamber and the low pressure reservoir or drain.

In use, operation of the shut-off valve in effect varies the ratio between the rate at which fuel can be supplied to the injection valve needle control chamber and the rate at which fuel can be drained from the injection valve needle control chamber. This enables the hydraulic command of the injector to be more readily optimised and thus enables enhanced performance from the injector. Unlike the prior art control arrangements no other features, such as an NPO or a differential section are required. A differential section can be in the form of a piston with a larger diameter than that of the needle. In this way the pressurised fuel inside the control chamber acts on a greater area than the pressurised fuel within the nozzle body such that the net force, acting to close the needle valve, increases. An NPO is an orifice which reduces the pressure inside the nozzle body during injection. The pressure drop results in the downwardly facing thrust surfaces of the valve needle being exposed to fuel at a lower pressure than the upwardly facing thrust surfaces, i.e. those at the top of the valve needle. Again, this increases the net force which acts to close the needle valve. In the present invention, an NPO, differential section, or the like is not required because there is a high flow rate into the control chamber, which provides the required net closing force. The present invention also allows the dynamic leakage to be reduced. This is advantageous because the lower loss of pressurised fuel means that the fuel injection system uses less energy. Also since the pressure of fuel passing through the fuel outlet passage is reduced the discharge valve can be unbalanced, thus eliminating static leakage, yet still operable by an actuator comparable to that used previously with a balanced discharge valve.

Preferably, the shut-off valve comprises a shut-off valve body within which the shut-off valve member, which is in the form of a piston, is slideably moveable within a piston chamber, the valve body being fluidly connected at a first end to the shut-off valve member control chamber, and being fluidly connected to the high pressure fuel transfer passage at a second end and at a intermediate fuel chamber between the two ends, and the valve body is provided with a valve seat between the intermediate position and the second end, and the piston is provided with a complementary valve face engageable with the valve seat to form a fluid tight closure within the high pressure fuel transfer passage when the shut-off valve is closed.

Preferably, the piston has at a first end, proximal to the first end of the valve body, a first thrust surface in fluid communication with the shut-off valve member control body, has at a second end proximal to the second end of the valve body, a second thrust surface in fluid communication with the injection valve member control chamber, and has intermediate the two ends a first intermediate thrust surface, proximal to the first end of the piston, and a second intermediate thrust surface, proximal to the second end of the piston, wherein the first intermediate thrust surface and the second intermediate thrust surface are in fluid communication with the intermediate fuel chamber.

Preferably, wherein the shut-off valve member is unbalanced. It is advantageous to have an unbalanced shut-off valve member, for example a piston, as this can be used to reduce the delay with which the shut-off valve member moves down when the discharge valve is closed and hence increases the speed with which the injection valve member, for example a valve needle, closes. The shut-off valve member is unbalanced because there is a difference between the sectional area of the shut-off valve member exposed to a force from pressurised fuel causing the shut-off valve member to move in a first direction, for example downwards, and the sectional area of the shut-off valve member exposed to a force from pressurised fuel causing the shut-off valve member to move in a second direction, opposite to the first direction, for example upwards. In the preferred embodiment of the present invention, the greater sectional area of the shut-off valve member is subjected to pressurised fuel which forces it in a downwards direction.

Alternatively, the shut-off valve member may be balanced. If the shut-off valve member is balanced, that is the sectional areas subjected to the forces in either direction from the fuel pressure are equal the delay with which the shut-off valve member moves down and hence the speed of closing of the injection valve can be increased by optimising the hydraulic system to obtain the preferred flow rates into and from the control chambers.

Preferably, a resilient element biases the shut-off valve member into a position in which the shut-off valve is open.

Preferably, a restriction is provided in the fuel transfer passage. This is advantageous because it allows the speed of movement of the injection valve member to be optimised. During the opening phase of the fuel injection valve, when the injection valve member, typically a valve needle, moves upwards it is necessary to have means by which the speed of movement of the injection valve member can be controlled. In the prior art this has been achieved by using a restriction in the fuel inlet passage. In the present invention there is no restriction in the fuel inlet passage. Instead, the speed of movement of the injection valve member is controlled with the compressive effect within the injection valve member control chamber. When the discharge valve is opened the pressure within the injection valve member control chamber is reduced and the injection valve member starts to move upwards. The reduction in pressure within the injection valve member control chamber is controlled by the restriction, typically an orifice, within the fuel transfer passage which links the injection valve member control chamber to the low pressure reservoir or drain. As the injection valve member moves upwards the volume of the injection valve member control chamber reduces and this tends to increase the pressure within it. The effect of the restriction in the transfer passage and the reduction in the volume of the injection valve member control chamber define an equilibrium pressure within the injection valve member control chamber during the opening phase which controls the opening speed of the injection valve member.

Preferably, the fuel injector further comprises a restricted fuel supply passage connected between a high pressure fuel supply passage and the shut-off valve member control chamber. It is advantageous to provide this restricted fuel supply passage to facilitate optimisation of the hydraulic system.

In a second alternative embodiment of the present invention the fuel injector may comprise a restricted fuel supply passage connected between a high pressure fuel supply passage and the shut-off valve member control chamber and a restricted fuel supply passage directly connected between a high pressure fuel supply passage and the injection valve member control chamber. The advantage of this second embodiment is that an inlet orifice in the restricted fuel supply passage to the injection valve member control chamber facilitates optimisation of the hydraulic command of the system by providing an additional degree of freedom to achieve an improved controlled flow.

The provision of the restricted fuel supply passage facilitates faster filling of the injection valve member control chamber when the discharge valve is closed and thus results in faster closing of the valve member. In the first embodiment there is a delay between the discharge valve closing and the shut-off valve member moving to open the high pressure fuel supply line to the injection valve member control chamber because it takes some time for the shut-off valve member control chamber to fill with pressurised fuel, due to the restriction provided in the shut-off valve member control chamber fuel supply line. The ability to close the valve needle more quickly facilitates short duration injections. Also, the orifice of the restricted fuel supply passage provides an extra degree of freedom which allows better optimisation of the hydraulic system.

In a fourth alternative embodiment of the present invention the fuel injector may further comprise a restricted fuel supply passage directly connected between a high pressure fuel supply passage and the injection valve member control chamber. It is advantageous to provide this restricted fuel supply passage to facilitate optimisation of the hydraulic system.

One of the critical aspects of the present invention is the hydraulic delay between the discharge valve opening or closing and the injection valve opening or closing. In order to close the injection valve quickly it is necessary to recharge the shut-off valve member control chamber quickly. In the preferred embodiment of the present invention this is achieved by supplying fuel directly to the shut-off valve member control chamber from the high pressure fuel supply (via a restriction). However, it is possible to realise the invention without having a high pressure fuel supply to the shut-off valve member control chamber. The fourth embodiment of the present invention uses such a system. In this arrangement a high pressure fuel line is provided to the injection valve member control chamber and this is used to fill the shut-off valve member control chamber via a fuel transfer passage from the injection valve member control chamber.

A preferred embodiment of the present invention will now be described with reference to the accompanying drawings in which:

BEST MODE FOR CARRYING OUT THE INVENTION

Figure 1:
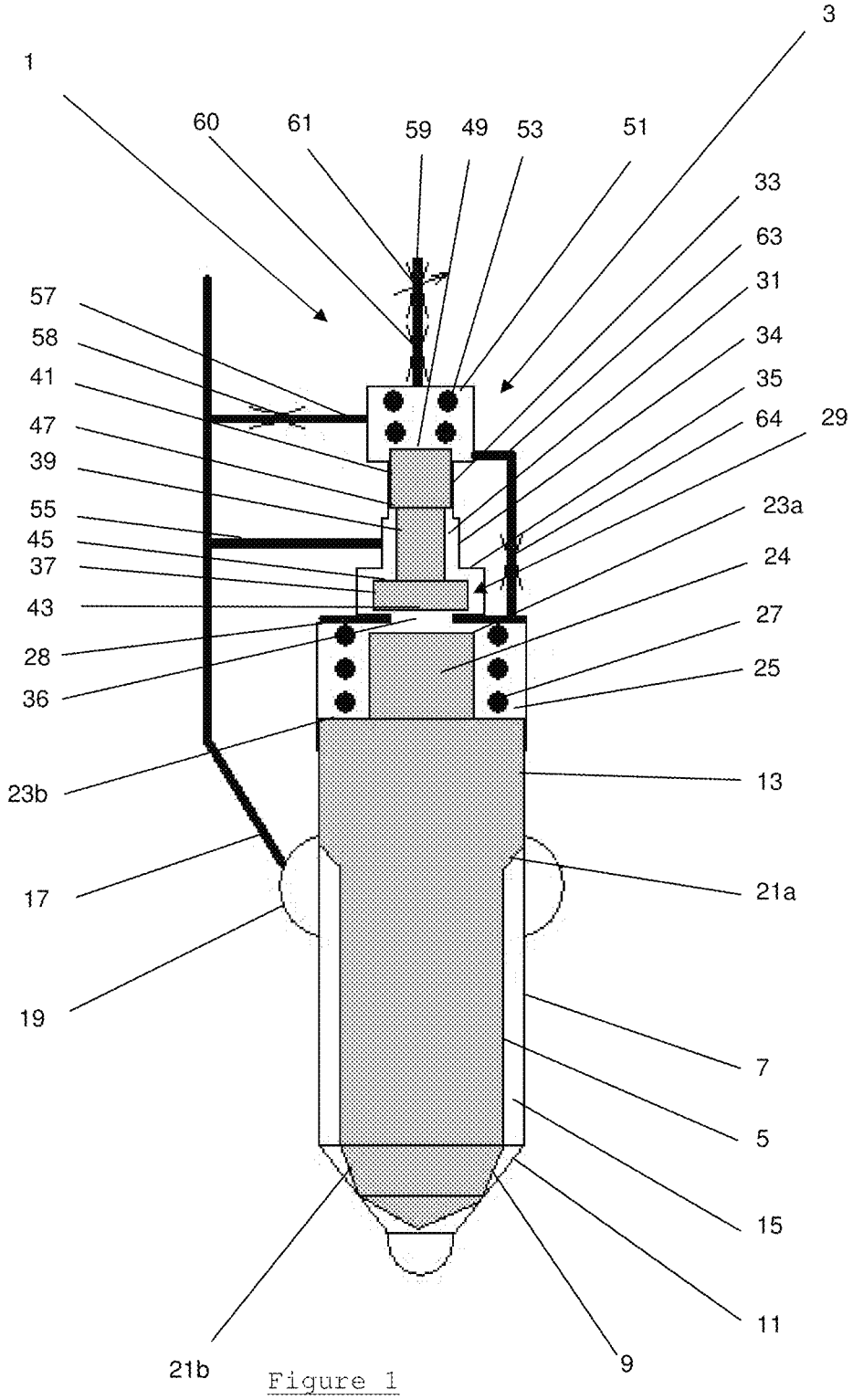
FIG. 1 is a partial schematic view of a fuel injector comprising an injection needle valve and a injection valve needle control arrangement according to a preferred embodiment of the present invention, for controlling the raising and lowering of the valve needle of the needle valve. The valve needle is shown in a seated position such that the injection orifices are closed.
Figure 2:
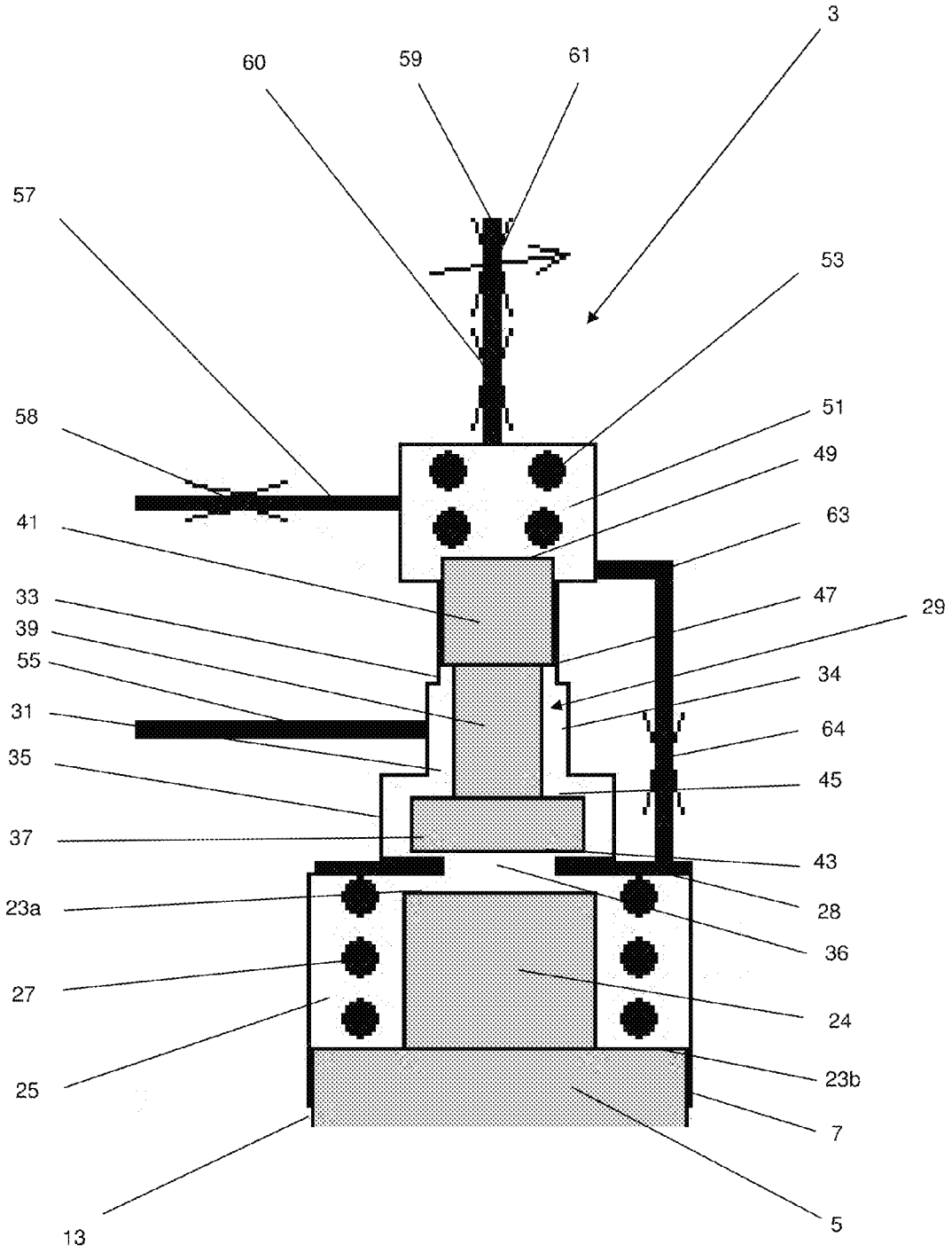
FIG. 2 is an enlarged schematic view of the injection valve needle control arrangement of FIG. 1.

A fuel injector 1, as shown in FIG. 1, is provided with a valve needle control arrangement 3 according to a preferred embodiment of the present invention. The fuel injector 1 comprises a conventional arrangement of a needle valve having a valve needle 5 located within the injector nozzle body 7.

The valve needle 5 is elongate, has a circular cross-sectional profile and comprises at a lower end a valve face 9 which is complementary in shape to a valve seat 11 provided on the nozzle body 7, such that when the valve face 9 contacts the valve seat 11 a fluid-tight seal is formed between them.

Towards its upper end the valve needle 5 is provided with a guide surface 13 which engages with the nozzle body 7 in a manner such that the valve needle 5 can slide relative to the nozzle body 7. The clearance between the valve needle 5 and the nozzle body 7 is minimised in order to minimise the flow of pressurised fuel across the guide section 13 from a fuel supply chamber 15, located between the valve face 9 and the guide section 13. The fuel supply chamber 15 is annular and is supplied by a high pressure fuel line 17 which feeds into an annular recess 19 within the nozzle body 7. The lower part of the guide section 13 is provided with a frustoconical medial thrust surface 21*a* and the bottom part of the valve needle 5 is provided with a frustoconical proximal thrust surface 21*b*. Pressurised fuel within the fuel supply chamber acts upon the thrust surfaces 21*a* and 21*b*.

At its upper end the valve needle 5 is provided with distal thrust surfaces 23*a*, 23*b* formed by the top of a cylindrical spring guide 24 and the annular surface around it respectively. These distal thrust surfaces 23*a*, 23*b* form the lower wall of a valve needle control chamber 25. The upper wall and the side walls of the valve needle control chamber 25 are formed by the nozzle body 7. Within the valve needle control chamber 25 there is provided a helical compression spring 27 which seats on the distal thrust surface 23*b* and the upper wall 28 of the valve needle control chamber 25.

The valve needle control arrangement 3 comprises a circular cross-section piston shown generally by reference numeral 29 within a circular cross-section piston chamber 31.

The piston chamber 31 has a stepped profile formed from three concentric bores. It comprises an upper bore 33, having the smallest diameter, an intermediate bore 34 having a larger diameter and a lower bore 35 having the largest diameter. The upper bore 33 is open at its upper and lower ends. At its lower end the upper bore 33 opens into the upper end of the intermediate bore 34, which in turn opens into the lower bore 35, which at its lower end has an opening communicating with an opening 36 in the upper wall 28 of the valve needle control chamber 25.

The piston 29 comprises a cylindrical lower valve portion 37, which is of greater diameter than the intermediate bore 34 and of smaller diameter than the lower bore 35, a cylindrical concentric intermediate portion 39 that is of smaller diameter than the upper bore 33, and a cylindrical concentric upper guide portion 41 that is of a diameter just smaller than the upper bore 33, such that the piston 29 is guided within the bore 33, and can slide relative to it, and such that the flow of fuel across the guide portion 41 is minimised.

The piston 29 is provided with a lower thrust surface 43 on the lower surface of the valve portion 37, a first intermediate annular thrust surface 45 on the upper surface of the valve portion 37, a second intermediate annular thrust surface 47 on the lower surface of the guide portion 41 and an upper thrust surface 49 on the upper surface of the guide portion 41. The area of the first intermediate annular thrust surface 45 is greater than the area of the second intermediate annular thrust surface 47.

The guide portion 41 extends outside of the upper bore 33 into a piston control chamber 51. The upper thrust surface 49 forms in part the lower wall of the piston control chamber 51. The remaining part of the lower wall, and the upper wall and the side walls are formed by the body of the fuel injector 1. Within the piston control chamber 51 there is a helical compression spring 53 which seats on the thrust surface 49 and the upper wall of the piston control chamber 51.

A high pressure fuel inlet line 55 is connected to the intermediate bore 34 of the piston chamber 31. A fuel inlet passage 57, provided with an inlet orifice 58, is connected to the piston control chamber 51. A fuel outlet passage 59, provided with a spill orifice 60, connects the piston control chamber 51 to a low pressure reservoir or drain. A discharge valve 61 is connected to the fuel outlet passage 59. The discharge valve is also provided with an orifice. However, the orifice in the discharge valve 61 is less restrictive than the spill orifice 60. A fuel transfer passage 63, provided with an orifice 64, connects the piston control chamber 51 and the valve needle control chamber 25.

In operation, when it is not desired to make an injection of fuel from the fuel injector 1 the discharge valve 61 is closed under the operation of an actuator (not shown) such that a net downwards force acts on the valve needle 5 to hold the valve face 9 against the valve seat 11. The net downwards force results from a force from the high pressure fuel within the valve needle control chamber 25 acting downwardly upon the distal thrust surfaces 23*a*,23*b* of the valve needle 5, in combination with a downwards spring force generated by the spring 27, being greater than the upwards force generated by high pressure fuel within the fuel supply chamber 15 (supplied via high pressure fuel line 17) acting on medial thrust surface 21*a* and proximal thrust surface 21*b* of the valve needle 5.

High pressure fuel is supplied to the valve needle control chamber 25 from two sources. The first supply originates from fuel inlet passage 57, passes through inlet orifice 58, passes through piston control chamber 51 and then passes into chamber 25 via the orifice 64 in transfer passage 63. The second supply is from high pressure fuel inlet passage 55, via the piston chamber 31.

The first action that needs to be taken in order to increase the pressure of fuel within the valve needle control chamber 25 is to close the outlet 59 from the piston control chamber 51 by closing the discharge valve 61 using the solenoid actuator (not shown). This prevents fuel supplied to the piston control chamber 51, from fuel inlet passage 57, exiting to the low pressure drain via fuel outlet passage 59. The high pressure fuel from inlet passage 57 fills the piston control chamber 51, thus increasing the fuel pressure within the piston control chamber 51. Also, high pressure fuel is transferred to the valve needle control chamber 25 via the orifice 64 in the transfer passage 63, thus increasing the fuel pressure within the valve needle control chamber 25.

The second action that needs to be taken in order to increase the pressure of fuel within the valve needle control chamber 25 is to open a fuel path between the high pressure fuel inlet passage 55 and the valve needle control chamber 25. To achieve this, a net downwards force must be applied to the piston 29 so that it moves downwards such that the lower valve portion 37 separates from the intermediate piston bore 35. When the pressure of fuel within the piston control chamber 51 has been raised to a level at which the force generated by the pressurised fuel acting on the upper thrust surface 49 of the piston 29, in combination with the downwards force applied by spring 53 and in combination with the force generated by the high pressure fuel from line 55 acting on first intermediate thrust surface 45, is greater than the upwards force acting on the lower thrust surface 43 from fuel passing through opening 36 from the valve needle control chamber 25, in combination with the force generated by the high pressure fuel from line 55 acting on second intermediate thrust surface 47, the piston 29 moves downwards.

When the piston 29 moves downwards the upper surface of the lower valve portion 37 separates from the upper surface of the lower bore 35. This opens up a fuel flow path between fuel inlet passage 55 and the valve needle control chamber 25. This results in the valve needle control chamber 25 rapidly filling with high pressure fuel from fuel inlet passage 55.

In operation, when it is desired to make an injection of fuel from the fuel injector 1 the valve needle 5 must be raised away from the valve seat 11 by applying a net upwards force to the valve needle 5. To achieve this, the pressure of fuel within the valve needle control chamber 25 must be reduced.

The first stage is to open the fuel outlet passage 59 from the piston control chamber 51 by opening the discharge valve 61 using the solenoid actuator (not shown). This enables high pressure fuel within the piston control chamber 51 and high pressure fuel flowing into the piston control chamber 51 from high pressure fuel inlet passage 57 and from fuel transfer passage 63, to be vented to the low pressure drain or reservoir and thus, as a first step, reduces the fuel pressure within the piston control chamber 51.

Venting the valve needle control chamber 25 via the fuel transfer passage 63 enables the pressure of the fuel within the valve needle control chamber 25 to be reduced.

Venting the piston control chamber 51 also has the effect that the net force acting on the piston 29 acts in an upwards direction because the force applied to the lower thrust surface 43, as a result of the pressurised fuel within the valve needle control chamber 25 acting via opening 36, in combination with the force applied to the second intermediate thrust surface 47, as a result of fuel pressure from fuel inlet passage 55, is greater than the force acting on the first intermediate thrust surface 45, from the pressure from fuel inlet passage 55, in combination with the force acting on the upper thrust surface 49, from the pressure of fuel within the piston control chamber 51, and in combination with the spring force from spring 53 acting downwards on the piston 29.

Upwards movement of the piston 29 places the upper surface of lower valve portion 37 into contact with the upper surface of bore 35, thus removing the flow path between the fuel inlet passage 55 and the valve needle control chamber 25.

Because the valve needle control chamber 25 is no longer supplied with high pressure fuel from fuel inlet passage 55 and the fuel within the valve needle control chamber 25 is vented via fuel transfer passage 63 and outlet passage 59, the pressure in the valve needle control chamber 25 reduces. At this point the net force acting on the valve needle 5 acts in an upwards direction because the downwards forces acting on the distal thrust surfaces 23*a*, 23*b*, from the pressure of fuel within the piston control chamber 25 and the spring 27 are less than the upwards forces acting on thrust surfaces 21*a*, 21*b*. Therefore, the valve needle 5 moves upwards, opening injection orifices and enabling fuel injection.

When it is required to cease injection the above described procedure for placing the valve needle 5 against the nozzle body 7 is employed.

The fuel inlet passage 57 to the piston control chamber 51, and the fuel outlet passage 59 and the fuel transfer passage 63 from it, are provided with orifices 58,60,64 respectively. The purpose of the spill orifice 60 is to reduce the effect of the tolerance on the lift of the valve member of the discharge valve 61. The distance by which the discharge valve member is raised from its valve seat changes the flow area of the valve. The spill orifice 60 reduces the fuel pressure directly below the discharge valve 61 when it is open. In reducing the fuel pressure the changes in the flow area have a smaller effect on the flow rate through the valve. The sensitivity of the system to the lift tolerance of the discharge valve is thereby reduced.

The orifice within the discharge valve 61 is provided in order to reduce the level of pressure that the discharge valve 61 is subjected to. This is because since the discharge valve 61 is an unbalanced valve, i.e. it is only subjected to high pressure on one side (the other side being connected to the low pressure reservoir), the larger the pressure at the high pressures side of the valve 61 the larger the solenoid actuator required to close it. Since the solenoid actuator must fit within the injector body its size is limited and thus its closing force is limited so the pressure to which the discharge valve 61 is subjected must be chosen accordingly.

The inlet orifice 58 is provided in the fuel inlet passage 57 in order to reduce the flow rate into the piston control chamber 51. If the restriction 58 were not provided, the flow rate into the chamber 51 would be greater than the possible flow rate away from the chamber 51 through fuel outlet passage 59 which is restricted by orifice 60 with the result that it would not be possible to discharge the chamber 51 in order to open the valve needle for injection.

During the opening phase of the needle valve, when the valve needle 5, moves upwards it is necessary to have means by which the speed of movement of the valve needle 5 can be controlled. In the present invention the speed of movement of the valve needle 5 is controlled with the compressive effect within the valve needle control chamber 25. When the discharge valve 61 is opened the pressure within the valve needle control chamber 25 is reduced and the valve needle 5 starts to move upwards. The reduction in pressure within the valve needle control chamber 25 is controlled by the orifice 64, within the fuel transfer passage 63. As the valve needle 5 moves upwards the volume of the valve needle control chamber 25 reduces and this tends to increase the pressure within it. The effect of the orifice 64 and the reduction in the volume of the valve needle control chamber 25 define an equilibrium pressure within the valve needle control chamber 25 during the opening phase which controls the opening speed of the valve needle 5.

Figure 3:
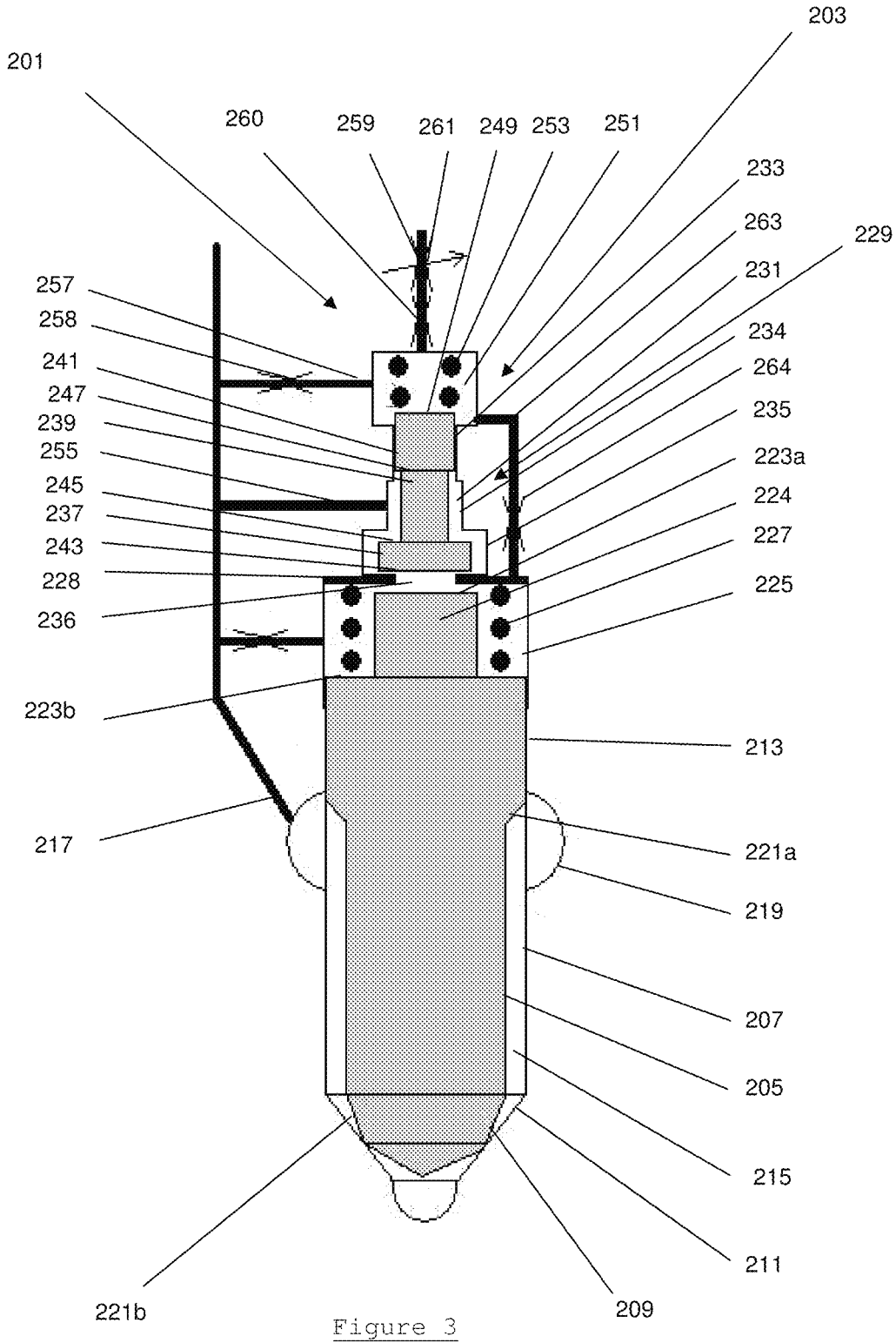
FIG. 3 is a partial schematic view of a fuel injector comprising an injection needle valve and a injection valve needle control arrangement according to a second embodiment of the present invention, for controlling the raising and lowering of the valve needle of the needle valve. The valve needle is shown in a seated position such that the injection orifices are closed.

A second embodiment of the present invention is shown in FIG. 3. This embodiment has all the features of the first embodiment (the equivalent features are given reference numerals with the prefix 2) and in addition a restricted fuel supply passage 270 between the high pressure fuel supply line 217 and the valve needle control chamber 225.

In operation, the second embodiment differs from the first embodiment in that the valve needle control chamber 225 can be filled with pressurised fuel from the fuel supply passage 270 in addition to being filled via the opening 236 and the fuel transfer passage 263. When optimising the hydraulic command of the injector the fuel supply passage 270 provides an additional degree of freedom for the optimisation.

Figure 4:
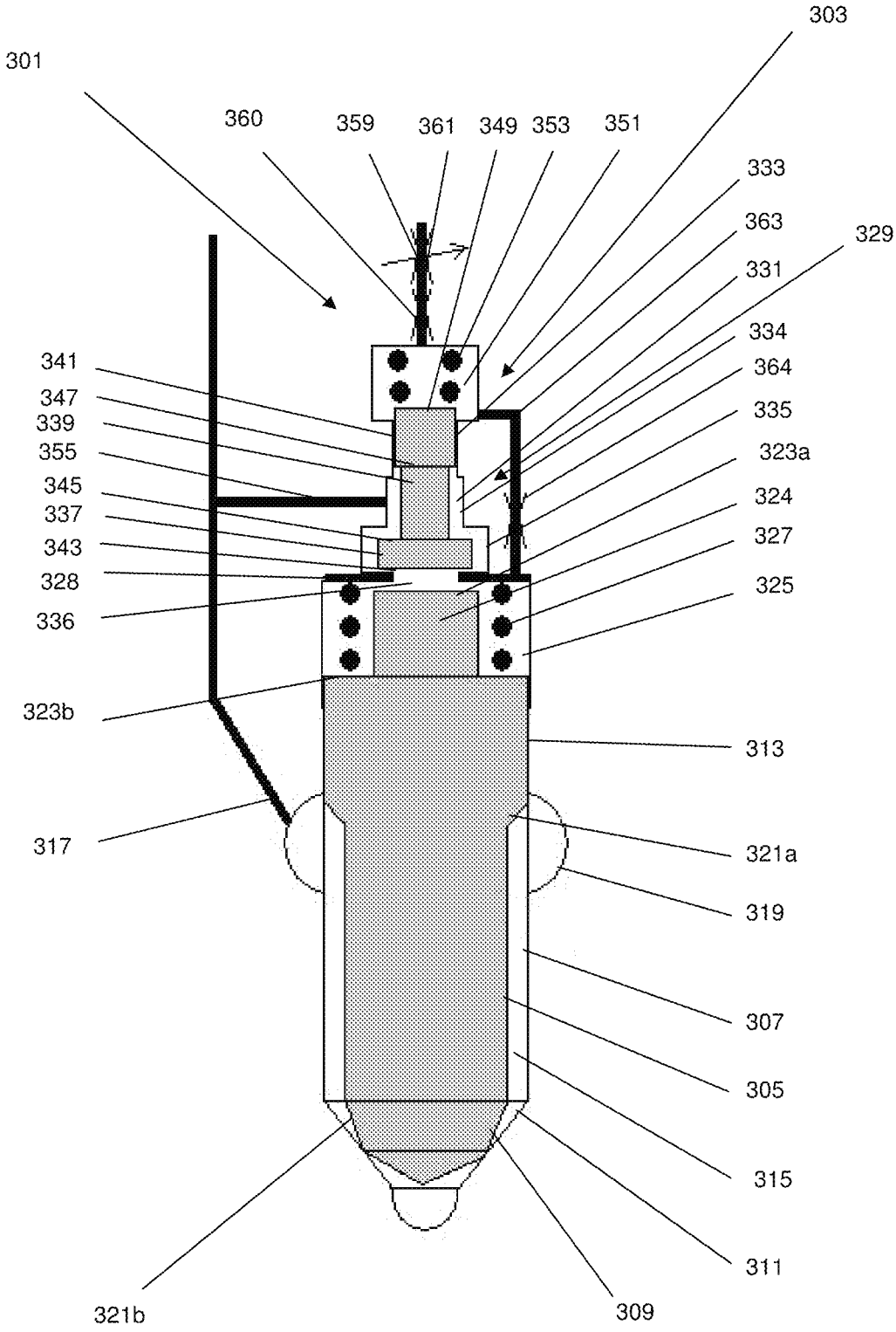
FIG. 4 is a partial schematic view of a fuel injector comprising an injection needle valve and a injection valve needle control arrangement according to a third embodiment of the present invention, for controlling the raising and lowering of the valve needle of the needle valve. The valve needle is shown in a seated position such that the injection orifices are closed.

A third embodiment of the present invention is shown in FIG. 4. This embodiment has all the features of the first embodiment (the equivalent features are given reference numerals with the prefix 3) except that there is no fuel inlet passage to the piston control chamber 351.

In operation, the third embodiment differs from the first embodiment in that the piston control chamber 351 can only be filled via the fuel transfer passage 363. When optimising the hydraulic command of the injector the absence of a fuel supply passage to the piston control chamber removes one degree of freedom for the optimisation.

Figure 5:
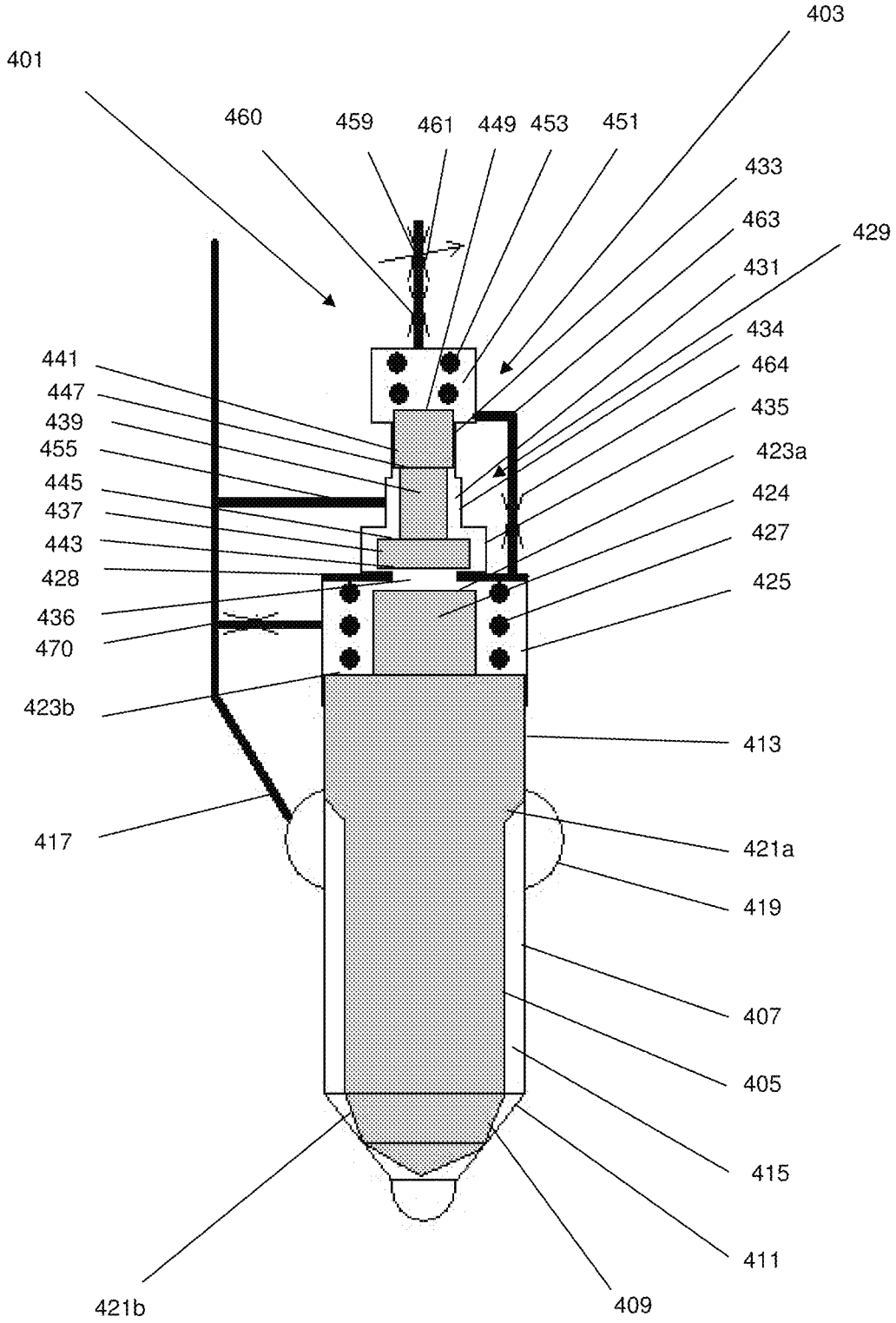
FIG. 5 is a partial schematic view of a fuel injector comprising an injection needle valve and a injection valve needle control arrangement according to a fourth embodiment of the present invention, for controlling the raising and lowering of the valve needle of the needle valve. The valve needle is shown in a seated position such that the injection orifices are closed.

A fourth embodiment of the present invention is shown in FIG. 5. This embodiment has all the features of the first embodiment (the equivalent features are given reference numerals with the prefix 4) except that there is no fuel inlet passage to the piston control chamber 451 and there is a restricted fuel supply passage 470 between the high pressure fuel supply line 417 and the valve needle control chamber 425.

In operation, the fourth embodiment differs from the first embodiment in that the piston control chamber 451 can only be filled via the fuel transfer passage 463. However, the valve needle control chamber 425 can be filled with pressurised fuel from the fuel supply passage 470. Consequently, the number of degrees of freedom, for optimising the hydraulic command of the injector, is maintained.

Figure 6:
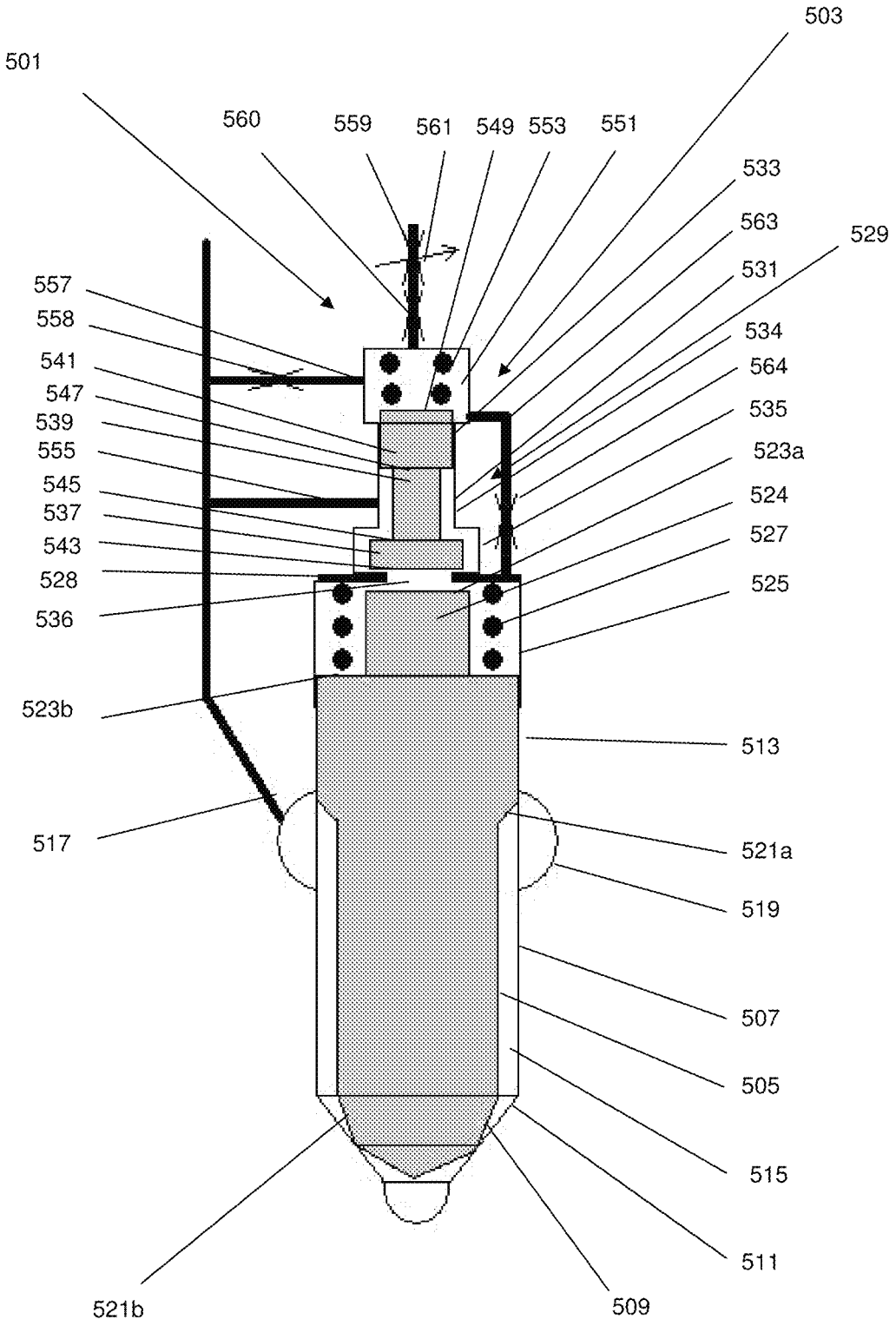
FIG. 6 is a partial schematic view of a fuel injector comprising an injection needle valve and a injection valve needle control arrangement according to a fifth embodiment of the present invention, for controlling the raising and lowering of the valve needle of the needle valve. The valve needle is shown in a seated position such that the injection orifices are closed.

A fifth embodiment of the present invention is shown in FIG. 6. This embodiment has all the features of the first embodiment (the equivalent features are given reference numerals with the prefix 5). However, the control valve arrangement 503 has a balanced piston arrangement. The use of a balanced piston arrangement will affect the optimisation of the different parameters because the closing delay will be increased in comparison to an unbalanced piston (with an unbalanced piston a net force required to move the piston downwards is achieved more quickly).

While this invention has been described in terms of the preferred embodiments thereof, it is not intended to be so limited, but rather only to the extent set forth in the claims that follow.

The invention claimed is:

1. A fuel injector for a compression ignition internal combustion engine comprising a fuel injection valve having an injection valve member moveable, in use, under the influence of fuel pressure within an injection valve member control chamber acting upon it, between a closed position and an open position, a high pressure fuel supply passage to the injection valve member control chamber, and an actuator operable to open and close a discharge valve connected between the injection valve member control chamber and a fuel outlet passage to a low pressure reservoir or drain, wherein a shut-off valve is provided in the high pressure fuel supply passage, the shut-off valve having a shut-off valve member moveable, in use, under the influence of fuel pressure within a shut-off valve member control chamber acting upon it, between a closed position and an open position, wherein the shut-off valve member control chamber is connectable to the low pressure reservoir or drain via the discharge valve, and wherein a fuel transfer passage is provided between the injection valve member control chamber and the low pressure reservoir or drain, characterized in that the shut-off valve controls a flow of fuel from the high pressure fuel supply passage to the injection valve control chamber, and the discharge valve controls a flow of fuel from the injection valve control chamber to the low pressure reservoir or drain.

2. A fuel injector for a compression ignition internal combustion engine comprising a fuel injection valve having an injection valve member moveable, in use, under the influence of fuel pressure within an injection valve member control chamber acting upon it, between a closed position and an open position, a high pressure fuel supply passage to the injection valve member control chamber, and an actuator operable to open and close a discharge valve connected between the injection valve member control chamber and a fuel outlet passage to a low pressure reservoir or drain, characterised in that a shut-off valve is provided in the high pressure fuel supply passage, the shut-off valve having a shut-off valve member moveable, in use, under the influence of fuel pressure within a shut-off valve member control chamber acting upon it, between a closed position and an open position, wherein the shut-off valve member control chamber is connectable to the low pressure reservoir or drain via the discharge valve, and wherein a fuel transfer passage is provided between the injection valve member control chamber and the low pressure reservoir or drain, wherein the shut-off valve comprises a shut-off valve body within which the shut-off valve member, which is in the form of a piston, is slideably moveable within a piston chamber, the valve body being fluidly connected at a first end to the shut-off valve member control chamber, and being fluidly connected to the high pressure fuel supply passage at a second end and at an intermediate fuel chamber between the two ends, and the valve body is provided with a valve seat between the intermediate chamber and the second end, and the piston is provided with a complementary valve face engageable with the valve seat to form a fluid tight closure within the high pressure fuel supply passage when the shut-off valve is closed.

3. A fuel injector as claimed in claim 2, wherein the piston has at a first end, proximal to the first end of the valve body, a first thrust surface in fluid communication with the shut-off valve member control chamber, has at a second end proximal to the second end of the valve body, a second thrust surface in fluid communication with the injection valve member control chamber, and has intermediate the two ends a first intermediate thrust surface, proximal to the first end of the piston, and a second intermediate thrust surface, proximal to the second end of the piston, wherein the first intermediate thrust surface and the second intermediate thrust surface are in fluid communication with the intermediate fuel chamber.

4. A fuel injector as claimed in claim 2, wherein the shut-off valve member is unbalanced.

5. A fuel injector as claimed in claim 2, wherein the shut-off valve member is balanced.

6. A fuel injector as claimed in claim 2, wherein a resilient element biases the shut-off valve member into a position in which the shut-off valve is open.

7. A fuel injector as claimed in claim 2, wherein a restriction is provided in the fuel transfer passage.

8. A fuel injector as claimed in claim 2, further comprising a restricted fuel supply passage connected between the high pressure fuel supply passage and the shut-off valve member control chamber.

9. A fuel injector as claimed in claim 2, further comprising a restricted fuel supply passage directly connected between the high pressure fuel supply passage and the injection valve member control chamber.

* * * * *